United States Patent [19]

Krolak et al.

[11] 4,203,643

[45] May 20, 1980

[54] ELECTRICAL RIBBON CONNECTOR AND HOOD

[75] Inventors: Ronald F. Krolak, North Riverside; Joseph Warywoda, Chicago, both of Ill.

[73] Assignee: Bunker Ramo Corporation, Oak Brook, Ill.

[21] Appl. No.: 927,253

[22] Filed: Jul. 24, 1978

[51] Int. Cl.[2] ..... H01R 13/58

[52] U.S. Cl. ..... 339/107; 24/257; 339/91 R

[58] Field of Search ..... 339/107, 103 B, 91 R; 24/257

[56] References Cited

U.S. PATENT DOCUMENTS

| | | | |
|---|---|---|---|
| 3,951,501 | 4/1976 | Bauerle et al. | 339/107 X |
| 4,035,051 | 7/1977 | Guy | 339/107 X |
| 4,127,315 | 11/1978 | McKee | 339/107 X |
| 4,127,316 | 11/1978 | McKee et al. | 339/103 R |

*Primary Examiner*—Neil Abrams
*Assistant Examiner*—DeWalden W. Jones
*Attorney, Agent, or Firm*—F. M. Arbuckle; W. Lohff; T. Scavone

[57] ABSTRACT

An electrical ribbon connector is disclosed having a protective hood which is assembled to or disassembled from a locked position on the connector insert member by either a sliding or pivoting technique. The hood is also automatically locked or secured in its final assembled position, and the locked or latched structure may be easily disengaged using a simple prying device such as a screwdriver. The connector body or insert member also includes retent structure for maintaining the plug and receptacle connectors in fully mated assembly but which also prevents contaminants from reaching the interior of the fully mated connectors.

15 Claims, 13 Drawing Figures

ELECTRICAL RIBBON CONNECTOR AND HOOD

BACKGROUND OF THE INVENTION

The present invention is directed generally to electrical connectors and, more particularly, to an improved all-plastic, electrical ribbon connector and an associated hood used to house or enclose the terminating section of the connector.

In recent years, a variety of multi-contact electrical connectors have been developed for use in the data processing and communications industries. A substantial demand for such connectors has arisen in the telephony market where multi-conductor, jacketed cable is used extensively in and between switching equipment, PBX's and computers. These connectors conventionally include an array of either solder or solderless terminals, each of which electrically connects or terminates an individual insulated conductor. In order to protect the connections formed between the bare ends of the conductors and the respectively associated terminals of the connector, a hood is conventionally employed and secured to the body of the connector to enclose or house the individual terminations. The connectors also typically include a strain relief cable clamping device which isolates the individual terminations from adverse tension loads.

For many years, conventional ribbon connectors have included a metal housing as a part of the connector body and metal protective hoods and cable clamping devices. Recently, however, a demand has arisen for ribbon connectors having most if not all of its exterior surfaces fabricated from an insulating material such as plastic. Such connectors are preferred since they reduce the possibility of inadvertently shorting non-insulated circuitry in close proximity to the connector in the telephone switching equipment and other concentrated circuit apparatus used in the telephone industry. Accordingly, a number of so called "all-plastic" connectors have been developed wherein the connector body and hood are fabricated from plastic and the metallic and electrically conductive components of the connector are completely or substantially housed within the plastic components. Typical examples of such prior art connectors wherein either the connector body or hood, or both, are fabricated of plastic are illustrated in U.S. Pat. Nos. 3,657,682; 3,803,530; 3,936,129; 4,035,051; 4,070,548; 4,089,579; and 4,090,770. While such prior art electrical ribbon connectors have met with considerable success in the market place, they nonetheless suffer from a number of disadvantages which have limited their applications and acceptance. Most significantly, the manner in which the prior art protective hoods are assembled and disassembled from the connector body in many instances limits the way in which the connector can be mounted or located within the associated electrical or telephonic equipment. For example, where the hood is assembled to the connector body by sliding it longitudinally along the body, the connector must be mounted such that there is sufficient spacing at its free end to accommodate this assembly procedure. Other connectors allow for pivotal assembly of the protective hood to the connector body, but these do not allow slidable assembly as well. Moreover, in those connector constructions which incorporate self latching hood structures, it is sometimes difficult to unlatch the hood from the connector body and special tools are required in some instances to facilitate the disassembly of the hood from the connector body.

Another disadvantage encountered with at least some prior art connectors is that the latching mechanisms used to maintain associated plug and receptacle connectors fully mated allow ingress of contaminates to the interior portions of the connector. Of course, whenever high density arrays of contacts are employed in an electrical connector, such as a ribbon connector, it is important that such contaminants be sealed from the interior of the mated connectors to insure the integrity of the many electrical interconnections therein.

SUMMARY OF THE INVENTION

Accordingly, the present invention is directed to an "all-plastic" electrical ribbon connector which overcomes or minimizes the disadvantages associated with the prior art connectors. The connector includes a connector body or insert member and protective hood both fabricated by injection molding and wherein the metal and electrically conductive components of the connector are substantially enclosed. The protective hood of the connector is easily assembled to a locked position on the connector body or disassembled from that position by either sliding the hood longitudinally along the connector body or pivoting the hood about one end of the connector body. In addition, the hood is automatically locked or secured in its finally assembled position, and the locking or latching structure may be easily disengaged using a simple prying device such as a screw driver. The connector body also includes a retention structure for maintaining the plug and receptacle connectors in fully mated assembly but which also prevents contaminants from reaching the interior of the mated connectors.

In addition to these functional improvements, the ribbon connector of the present invention and its associated hood are designed such that they may be easily and inexpensively fabricated by injection molding on a single-action mold which helps to reduce their cost of manufacture. Finally, the design of the connector body is such that an improved cable clamping device may be secured to, and the protective hood may be mounted from, either of its ends, thereby providing greater flexibility to the user in the installation of the connectors in the field.

In accordance with one embodiment of the present invention an electrical connector is provided having an elongated insert member, a plurality of electrical contacts mounted within the insert member, a protective hood, and latch and latch engaging means for securing the hood to the insert member. The insert member includes first and second ends, a mating section to receive and engage a complementary electrical connector, and a terminal section to receive electrical conductors for termination to the connector. The electrical contacts are supported within the insert member and extend from its mating section to its terminal section. The protective hood is mounted to and encloses the terminal section of the elongated insert member, thereby protecting the individual electrical connections or terminations between the contacts and the conductors of the associated cable. The latch means forms a part of or is connected to each end of the insert member, and means for engaging the latch means are formed in each end of the hood. The latch and latch engaging means are configured and arranged to include cooperating means to permit assembly and disassembly of the hood to and from a locked position on the insert member by either sliding the hood longitudinally along the insert member or pivoting the hood about one of the insert member.

A principal feature of the present invention, therefore, is the provision of an "all plastic" electrical connector having a protective hood may be assembled to the connector body or insert member in more than one manner.

Another feature of the invention is the provision of an "all plastic" ribbon connector having a hood which latches or locks to the insert member automatically upon assembly and which is easily disassembled from the connector body either manually or with a simple hand tool.

Still another feature of the present invention is the provision of an electrical ribbon connector having a retention structure for maintaining mated pairs in fully mated assembly while preventing substantially the ingress of contaminants to the interior of the mated connectors.

A further feature of the present invention is the provision of an "all plastic" electrical ribbon connector including a protective hood which is very low in cost due to the fact that the insert member and hood are capable of manufacture in a single-action injection molding process.

BRIEF DESCRIPTION OF THE DRAWINGS

The novel features which are believed to be characteristic of the invention are set forth in the appended claims. The invention itself, however, together with further objects, features and attendant advantages thereof, will be best understood by reference to the following description taken in connection with the accompanying drawings in which:

DETAILED DESCRIPTION OF THE INVENTION

Figure 1:
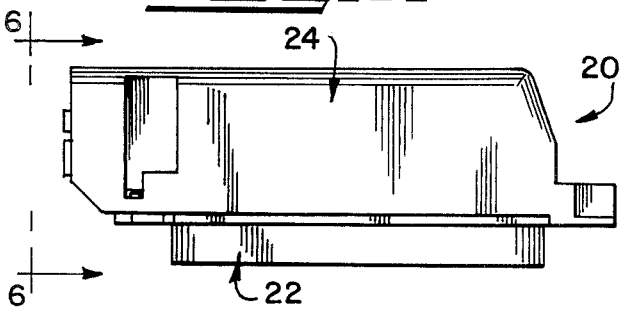
FIG. 1 is a side elevational view illustrating the all-plastic connector of the present invention having its protective hood assembled in the locked position on the insert member.
Figure 5B:
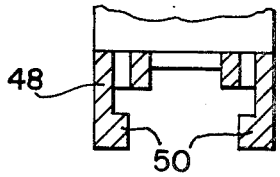
FIG. 5B is a cross-sectional view taken along line 5B—5B of FIG. 3 and illustrating in greater detail the structure and configuration of the forward end of the hood.
Figure 2:
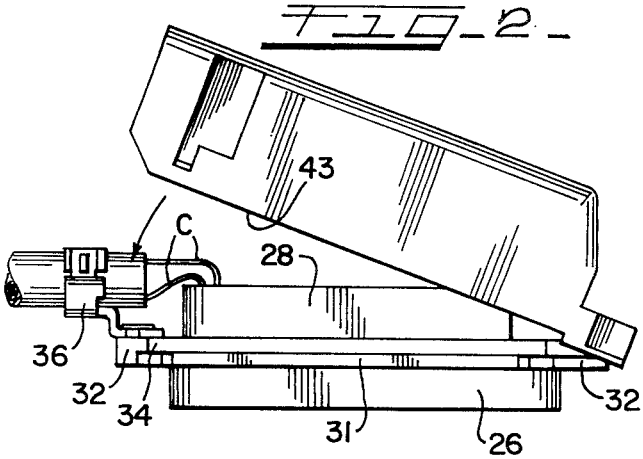
FIG. 2 is a side elevational view illustrating the assembly of the hood to the insert member via the pivotal technique wherein the hood is pivoted to the locked position about one end of the insert member.
Figure 3:
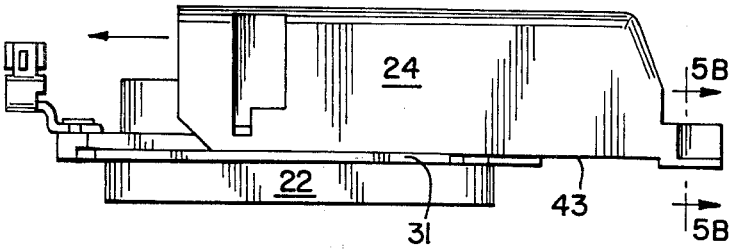
FIG. 3 is a side elevational view illustrating assembly of the hood via the sliding technique wherein the hood is slid longitudinally along the insert member to the locked position.

Referring not to the drawings, and particularly FIGS. 1-3, a ribbon connector is designated generally as 20 and includes a connector body or insert member 22 and a protective hood 24. The connector 20 is of the "all-plastic" type in that substantially all of its external surfaces are a dielectric plastic material. The insert member 22 in FIGS. 1-3 is a plug-type, but this is only for illustrative purposes, and the following description of the connector components, except where noted, is equally applicable to a receptacle-type insert member. Insert member 22 has a mating section 26 for interengagement with a complimentary connector and a terminal section 28 which supports means for terminating the individual conductors C of an associated electrical cable. The terminating means may be conventional ribbon connector contacts of the solder or solderless type several of which are well known in the art. The insert member 22 also includes identically configured end flanges 32 and a railing or track 31 which extends along each side of the insert member between the mating and terminal sections 26 and 28. The flanges 32 each have latch means comprising a pair of stationary projections 34 which cooperate with latch engaging means on the hood as described herein below.

Connector 20 also includes a strain relief mechanism 36 which is mounted on one end of the insert member 22 to relieve the conductors C and their respective terminations from any tension loads applied to the cable. The strain relief mechanism includes latch means comprising laterally extending tabs 38 (FIG. 7) which also cooperate with latch engaging means incorporated into the hood 24 as described below.

It should be noted that the locationally descriptive terms such as "front", "rear", "top" or "upper" and "bottom" or "lower" are used herein and in the appended claims to refer to the orientation of the connector components as illustrated in FIGS. 1-3. For example, the "forward" end of the connector 20 is to the right in FIGS. 1-3.

Figure 6:
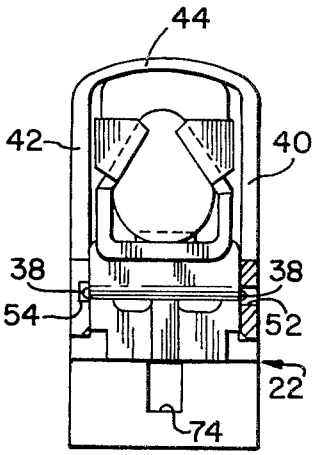
FIG. 6 is an end view taken from the rearward end of the connector along line 6—6 of FIG. 1.
Figure 4:
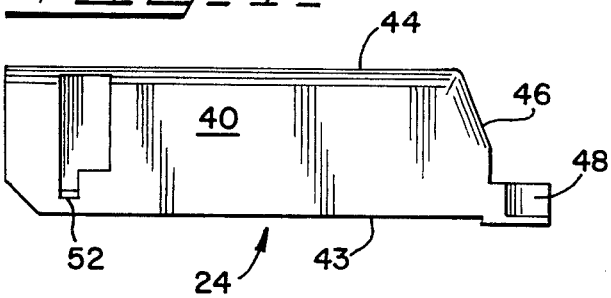
FIG. 4 is a side elevational view of the protective hood alone.
Figure 5:
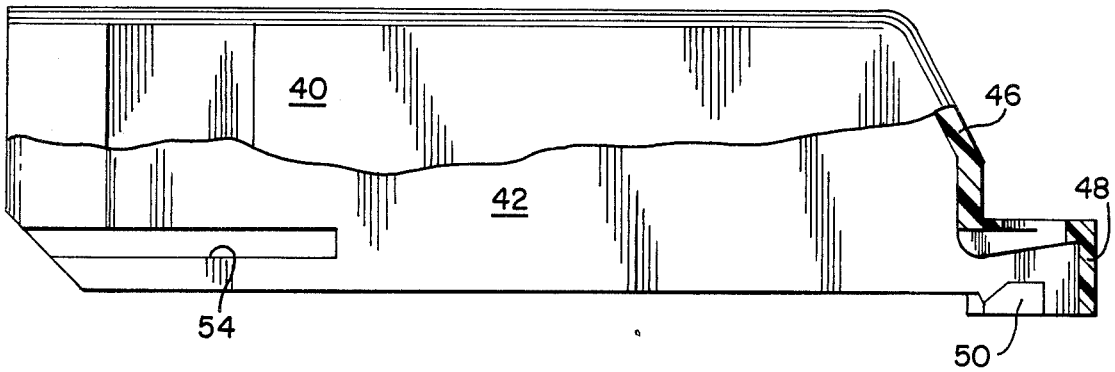
FIG. 5 is an enlarged side elevational view of the hood similar to that of FIG. 4 with a portion of one sidewall broken away to illustrate the internal configuration of the opposing sidewall and the structure at the forward end of the hood.
Figure 5A:
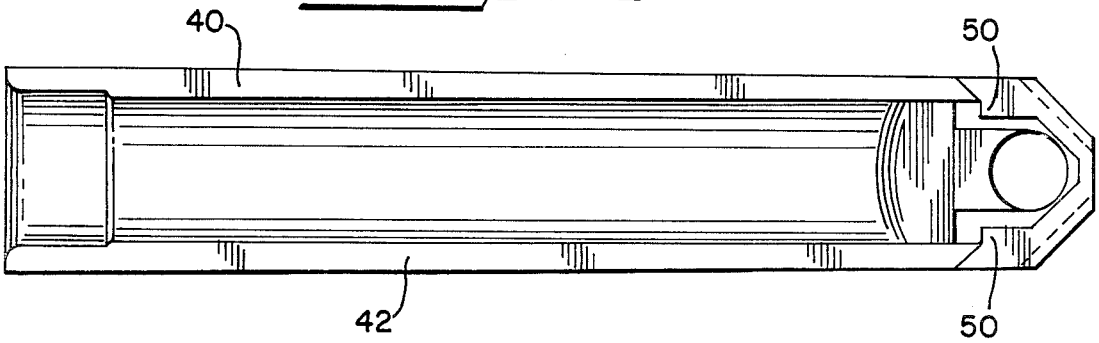
FIG. 5A is a bottom view of the hood illustrated in FIG. 5.

The protective hood 24, illustrated in greater detail in FIGS. 4-6, includes sidewalls 40 and 42, a top wall 44 and a forward end wall 46 which together define an enclosure for housing the terminal section 28 of the insert member 22. In accordance with the present invention, the hood 24 may be assembled to a locked position on the insert member by either a pivotal or sliding technique, and the structure of the hood and insert member include cooperating means to achieve that end. The end wall 46 includes a stationary latch engaging means comprising hood portion 48 having inwardly extending lips 50. When the insert member 22 and hood 24 are fully assembled, the flange 32 at the forward end of the insert member nests within the hood portion 48 with the lips 50 directly beneath and contiguous with the flange projections 34. The hood 24 includes further latch engaging means adjacent its rearward end including an aperture 52 in sidewall 40 and a groove 54 in the inside surface of sidewall 42. As is most clearly seen in FIG. 6, aperture 52 and groove 54 engage and register with the tabs 38 of the strain relief clamp 36 when the hood and insert member are fully assembled. The latch engaging means at the rear of the hood, aperture 52 and groove 54, are "movable" in that they are formed in the resilient sidewalls 40 and 42, each of which is laterally flexable at least at its lower portion remote from top wall 44.

It will be appreciated from the foregoing description that the hood 24 may be easily assembled to the insert member 22 by first inserting the flange 32 at the forward end of the insert member into the cavity defined by hood portion 48 and then pivoting the hood, as shown by the arrow in FIG. 2. As the hood is assembled to the insert member in this manner, the sidewalls 40 and 42 flex outwardly over the camming surfaces 39 and 41 of tabs 38 until the lower free edges 43 of the sidewalls abut railing 31. At this point the sidewalls snap inwardly with the tabs 38 in full registry with aperture 52 and groove 54. The stationary projections 34 of forward flange 32 are also fully seated within the hood portion 48, and, as a result, the hood 24 is locked in place.

Alternatively, the hood 24 may be mounted to the insert member 22 by sliding it longitudinally along railing 31. When mounting the hood in this manner only sidewall 40 is flexed outwardly, since the groove 54 in sidewall 42 extends to the rearmost edge of the hood and is in full registry with its associated tab 38 throughout the assembly procedure. As the hood reaches its final position sidewall 40 snaps inwardly with the aperture 52 in full registry with its respective tab 38. It should be noted that the hood need not be slid the entire length of the insert member, rather it can be placed over the insert member as shown in FIG. 3 and then moved longitudinally along railing 31. Thus, the free edges 43 of the hood sidewalls 40 and 42 and railing 31 serve as indexing means, in that when they abut, the latch and latch engaging structures of the hood and insert member are properly aligned for assembly.

Removal of the hood is also facilitated by the present invention and simply requires outward displacement of the lower rear portion of sidewall 40 by means of a small screwdriver or other hand tool. Once aperture 52 is disengaged from its associated tab 38, the hood is free to slide from the insert member. Alternatively, sidewalls 40 and 42 can be simultaneously spread apart and the hood then pivoted free of the insert member.

Figure 7:
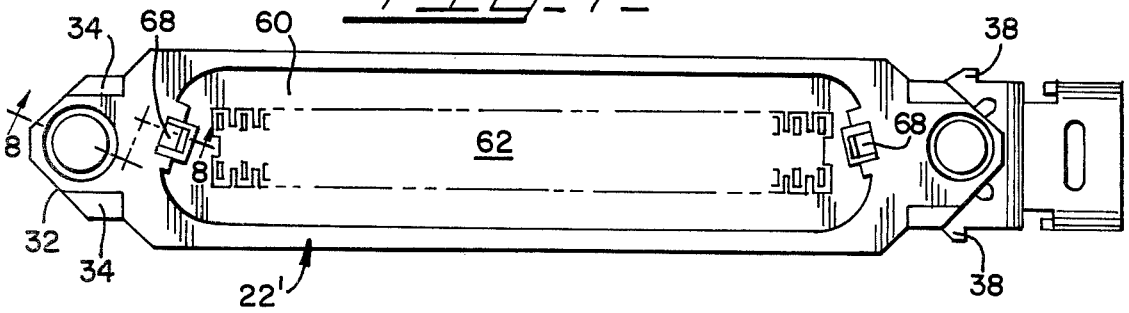
FIG. 7 is a bottom view of a receptacle connector insert member showing its mating section and illustrating the assembly of a strain relief clamping device at one end thereof.
Figure 9:
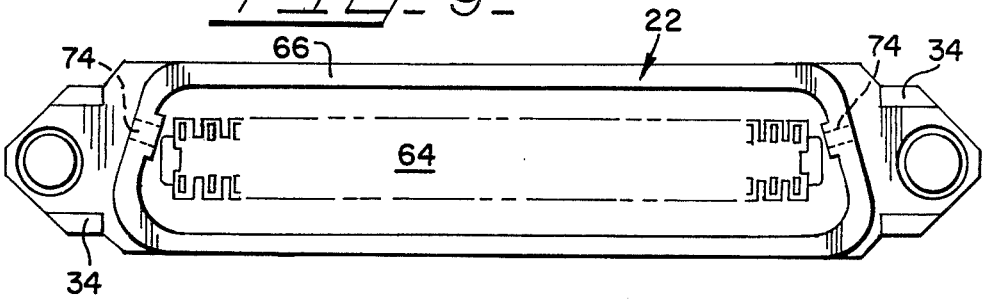
FIG. 9 is a bottom view of a plug connector insert member showing its mating section but without a strain relief clamping device.

In accordance with another feature of the present invention, the retention mechanism used to maintain the plug and receptacle connectors fully mated is provided with means to prevent the passage of contaminants into the interior of the mated connector assembly. FIGS. 7 and 9 illustrate the complimentary mating sections of receptacle and plug-type insert members 22' and 22, respectively. The receptacle insert member 22' includes a depending peripheral wall 60 which defines a plug-receiving cavity 62, whereas the plug insert member 22 includes a central plug body 64 and depending skirt 66. These components are configured to accommodate telescoping interengagement such that when fully mated the plug body 64 is disposed within the cavity 62 while skirt 66 is disposed outside the peripheral wall 60.

Figure 8:
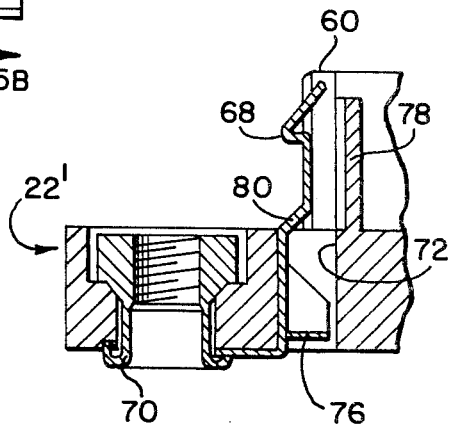
FIG. 8 is an enlarged cross-sectional view taken along line 8—8 of FIG. 7 and illustrating in greater detail the improved connector locking structure of the present invention.
Figure 10:
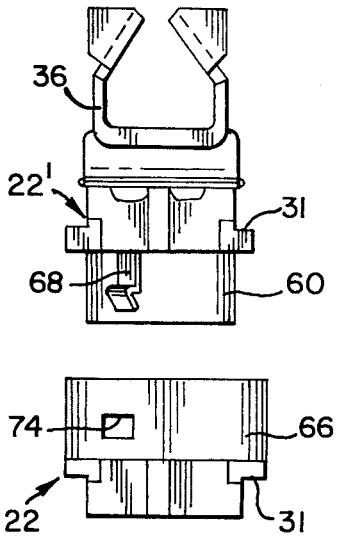
FIG. 10 is an end view illustrating both hooded plug and receptacle insert members aligned for mating.
Figure 11:
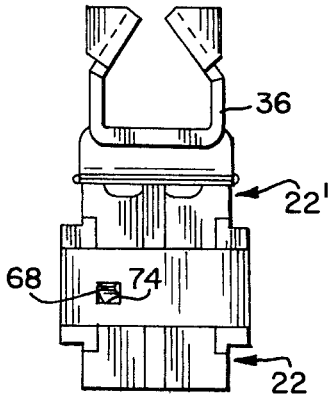
FIG. 11 is an end view similar to that of FIG. 10 but showing the plug and receptacle insert members in fully mated and locked assembly.

The receptacle insert member 22' also includes a laterally deflectable detent or leaf spring 68, shown in detail in FIG. 8, which is mounted to the insert member by rivet 70. The leaf spring extends through passageway 72 and protrudes from the peripheral wall 60. As shown in FIGS. 10 and 11, the detent 68 is aligned with an aperture 74 in the skirt 66 of the plug member 22, and upon fully mating of the plug and receptacle members the detent 68 locks into aperture 74 thereby retaining the assembly in this fully mated condition. To release the connectors the detent is depressed to disengage the aperture 74, after which the mating section of the receptacle member may be removed from the skirt 66 of the member.

In accordance with the present invention, the detent or leaf spring 68 includes a transverse flange 76 which substantially closes passageway 72 thereby preventing entry of contaminants into interior of the mated connector components. In addition, peripheral wall 60 includes a partition 78 behind the leaf spring 68 which extends to a height slightly less than that of the wall 60, itself. The partition 78 also obstructs the passage of contaminants into the mated connector, but at the same time accommodates full deflection of the spring 68 during mating and unmating of the plug and receptacle. The flange 76 also strengthens the spring 68 and helps to focus or concentrate deflection of the spring at its mid portion 80. This increases the detent forces without having to use heavier gage sheet metal stock which would be more difficult to use in fabricating the spring.

Of course, it should be understood that various changes and modifications to the preferred embodiments described herein will be apparent to those skilled in the art. Such changes and modifications can be made without departing from the spirit and scope of the present invention and without diminishing its attendant advantages. It is, therefore, intended that such changes and modifications be covered by the following claims.

We claim:

1. An electrical connector comprising:

an elongated insert member having first and second ends, a mating section to receive a complimentary electrical connector and a terminal section to receive electrical conductors for terminating to the connector;

a plurality of electrical contacts supported within said insert member and extending from said mating section to said terminal section;

a hood for enclosing said terminal section of said insert member; and latch means associated with each end of said insert member and means for engaging said latch means associated with each end of said hood, said latch and latch engaging means having cooperating means for selectively assembling and disassembling said hood to and from a locked position on said insert member by either sliding said hood longitudinally along said insert member or pivoting said hood about one end of said insert member.

2. The electrical connector of claim 1 wherein said cooperating means permit assembly and disassembly of said hood to and from said locked position on said hood by sliding said hood a predetermined distance along said insert member less than the entire length of said insert member.

3. The electrical connector of claim 1 wherein said cooperating means comprise stationary projections on said insert member, stationary receptacles on a forward end of said hood and movable receptacles on a rearward end of said hood, both said stationary and movable receptacles receiving said projections when said hood is assembled in said locked position.

4. The electrical connector of claim 3 wherein said hood includes a pair of resilient and outwardly displaceable sidewalls and said movable receptacles comprise an aperture in one sidewall and a groove on the interior of the other sidewall opposite said aperture, said movable receptacles being disengagable from said projections by outward displacement of said sidewalls.

5. The electrical connector of claim 4 wherein said hood may be slidingly disassembled from the locked position on said hood by outward displacement of only said one sidewall.

6. An electrical connector comprising:

an elongated dielectric insert member having first and second ends, a mating section adapted for mating engagement with a complimentary electrical connector and a terminal section to receive electrical conductors for termination;

a plurality of electrical contacts extending through said insert member from said terminal section to said mating section; and a hood having at least two sidewalls for enclosing said terminal section of said insert member, said hood and said insert member including cooperating means for selective assembly and disassembly of said hood to and from a locked position on said insert member by either sliding said hood longitudinally on said insert member or pivoting said hood about one end of the insert member.

7. The electrical connector of claim 6 wherein said hood may be slidably assembled or disassembled to and from said locked position by moving said hood longitudinally a predetermined distance along said insert member less than the entire length of said insert member.

8. The electrical connector of claim 6 wherein said hood includes resilient outwardly displaceable sidewalls and said cooperating means includes movable receptacles comprising an aperture in one hood sidewall and a groove on the interior of the other hood sidewall opposite said aperture, said movable receptacles engaging projections on said insert member when said hood is in said locked position.

9. The electrical connector of claim 8 wherein said hood may be slidingly disassembled from the locked position on said hood by outward displacement of only said one hood sidewall.

10. The electrical connector of claim 6 wherein said cooperating means includes stationary receptacles formed in said hood to receive and engage flange projections on said insert member when said hood is in said locked position.

11. The electrical connector of claim 10 wherein said insert member first and second ends include identically configured flanges having said flange projections, whereby said hood stationary receptacles may engage either end of said insert and said hood may be assembled in opposite longitudinal orientations on said insert member.

12. The electrical connector of claim 6 further including clamping means for mechanically retaining said electrical conductors adjacent said terminal section of said insert member, said clamping means being disposed at the end of said insert member opposite the end about which said hood is pivoted and including means for maintaining said clamping means in longitudinal alignment with said insert member.

13. The electrical connector of claim 12 wherein said cooperating means includes laterally extending tabs on said clamping means engageable with movable receptacles on said hood.

14. The electrical connecting of claim 13 wherein said tabs have first and second camming surfaces to facilitate assembly of said hood to said insert member.

15. An electrical connector assembly comprising:

an insert member having first and second ends, a mating section adapted for mating engagement with a complimentary electrical connector and a terminal section to receive electrical conductors for termination;

a plurality of electrical contacts extending from said terminal section to said mating section;

clamping means for mechanically retaining said electrical conductors adjacent said terminal section of said insert member;

a hood for enclosing said terminal section of said insert member and said clamping means; and cooperating means on said insert member, clamping means and hood permitting selective assembly and disassembly of said hood to and from a locked position on said insert member by either sliding said hood longitudinally on said insert member or pivoting said hood about one end of the insert member.

* * * * *